US006574883B2

(12) United States Patent
Giblin et al.

(10) Patent No.: US 6,574,883 B2
(45) Date of Patent: Jun. 10, 2003

(54) DISPENSING FOR DRYER

(75) Inventors: Edward John Giblin, Hopatcong, NJ (US); Feng-Lung Gordon Hsu, Tenafly, NJ (US); Corrine Saso, Ridgefield Park, NJ (US); Ramon E. Poo, Miami, FL (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/749,968

(22) Filed: Dec. 28, 2000

(65) Prior Publication Data

US 2002/0083615 A1 Jul. 4, 2002

(51) Int. Cl.[7] ..... F26B 19/00

(52) U.S. Cl. ..... 34/90; 34/60; 34/61; 34/63; 68/17 R; 510/519; 222/129; 222/158; 222/212; 222/463; 222/500

(58) Field of Search ..... 34/60, 61, 63, 34/68, 90; 68/17 R, 213; 510/519, 520; 222/129, 158, 207, 212, 463, 500

(56) References Cited

U.S. PATENT DOCUMENTS 3,633,538 A * 1/1972 Hoeflin ..... 118/76
3,706,140 A * 12/1972 Brillaud et al. ..... 34/60

(List continued on next page.)

FOREIGN PATENT DOCUMENTS

| | | |
|---|---|---|
| EP | 0 328 863 | 8/1989 |
| EP | 0 368 680 | 5/1990 |
| EP | 0 490 577 A1 | 6/1992 |
| WO | 99/15759 | 4/1999 |

OTHER PUBLICATIONS

Photo 1 –front view of Downy Ball.
Photo 2 –top view of Downy Ball.
Photo 3 –Downy Ball and stopper removed.

*Primary Examiner*—Ira S. Lazarus
*Assistant Examiner*—Kathryn S. OMalley
(74) *Attorney, Agent, or Firm*—Gerard J. McGowan, Jr.

(57) ABSTRACT

A dispenser for laundry products, particularly for fabric softener products to be used in the dryer. The dispenser comprises a hollow ball having a plurality of product dispensing openings and a further product ingress opening for placing product in the ball. A measuring cup to hold product is accessed from the product ingress opening. In accordance with one preferred embodiment, the measuring cup includes only a single opening in its side wall for releasing product from the cup and into the hollow sphere. One or more closures are associated with the dispenser. After travelling through the small hole in the cup, the product is dispensed to the exterior of the hollow ball through the product dispensing openings and thus onto product. The hollow ball is preferably a manually squeezable plastic such as polyurethane. In another embodiment, the cup includes more than the single hole in the cup walls. In a further embodiment, the cup may include a single hole or a plurality of holes and the hollow ball has associated therewith fabric on the outside surface to assist in evenly dispensing product. In an alternative embodiment, the cup includes a single hole or a plurality of holes and the outside of the hollow ball includes a plurality of wells to assist in dispensing of product. In accordance with a still further embodiment of the invention, the dispenser includes a duck bill valve sealingly mounted within the measuring cup. Product can be pumped into the dispenser through the duck bill valve, in which case, the closure may be omitted if desired. In accordance with yet another embodiment of the invention, the area of the closure on the hollow ball is recessed and is protected by a ridge of plastic formed in the hollow ball.

36 Claims, 5 Drawing Sheets

U.S. PATENT DOCUMENTS 3,888,391 A * 6/1975 Merz ..... 222/52
4,014,105 A * 3/1977 Furgal et al. ..... 118/76
4,512,041 A * 4/1985 Tsai ..... 4/227
4,883,203 A * 11/1989 Kittscher ..... 222/143
5,040,311 A * 8/1991 Roy ..... 34/60
5,129,120 A * 7/1992 Cornette et al. ..... 8/158
5,267,671 A * 12/1993 Baginski et al. ..... 222/154
5,279,409 A * 1/1994 Bowie et al. ..... 206/0.5
5,314,098 A * 5/1994 Milenkevick ..... 222/463
5,355,541 A 10/1994 Rutter et al. ..... 8/158
5,531,081 A * 7/1996 Savkar et al. ..... 68/17 A
5,768,918 A * 6/1998 McKibben ..... 68/17 R
6,010,540 A * 1/2000 Telesca et al. ..... 8/142
6,174,577 B1 * 1/2001 Vitorino ..... 428/36.5

* cited by examiner

DISPENSING FOR DRYER

BACKGROUND OF THE INVENTION

Many consumers appreciate the tactile characteristics imparted to fabrics by modern fabric softener products. However, as convenient as the present forms of fabric softener dispensing are, there is still room for improvement. For instance, liquid fabric softeners generally must be added to the wash at a particular point during the washing cycle, and direct application to the clothes generally should be avoided. Another form of fabric softener is the dryer sheet which is a sheet impregnated with fabric softener which can be tossed into the dryer. However, one problem attendant to use of this form of fabric softener is the fact that the used sheet generally must be disposed of.

It has been proposed to dispense fabric softener and other laundry products using a ball which is tossed into the dryer or another laundry apparatus.

Birllaud et al., U.S. Pat. No. 3,706,140 is directed to a dispenser which is an open celled housing or vessel forming a chamber permeable to ingress and egress of fluids to permit dispensing of such fluids from the chamber into a desired environment. A means is mounted in or on the vessel for loading and holding of materials to be dissolved or volatilized and for passing the dissolved substance or the resulting gas to the chamber for dispensing or escape through the permeable walls of the vessel.

The '140 dispenser is said to be particularly adapted for use in either home dryers or commercial laundry dryers which will permit scenting, deodorizing, water-proofing, germ-proofing or disinfecting of laundered items. Treating materials which have properties adapting them to volatilize at a point at which the temperature of the laundered items passed to the elevated temperature of the ambient heating medium can be used to perfume, disinfect, moth proof and to waterproof the laundered items or to coat them with anti-microbiological substance or apply a variety of other treatments. The treating material or protective carrier will melt or degrade when a critical temperature is reached.

The '140 dispenser includes a generally spherical housing. The sphere may include a basket portion. The spherical housing may be made of stainless steel sheeting or plastics, such as fluorocarbon resins, polypropylenes, polystyrenes, etc. The spherical housing is provided with a plurality of spaced openings. The spherical housing may be provided with a plurality of indented sections which serve to strengthen the relatively thin walls. A hinged closure is disclosed. The basket element has perforations in the order of 30 gauge mesh.

The Procter and Gamble has sold prior to the invention of the present invention a product called the Downy ball.

Other patents disclosing fabric softener or other devices include Bolan et al., U.S. Pat. No. 4,304,562, Anderson, U.S. Pat. No. 5,966,831, Furgal et al., U.S. Pat. No. 4,014,105, Sachs, U.S. Pat. No. 4,532,722, Cobb, U.S. Pat. No. 2,941,309 Cornette et al., U.S. Pat. No. 4,703,872, Falivene, U.S. Pat. No. 4,057,673, Kunzel et al., U.S. Pat. No. 4,183,981, Roy, U.S. Pat. No. 5,040,311, Rennie, U.S. Pat. No. 4,567,675, Davies, U.S. Pat. No. 4,532,719, Vesborg, U.S. Pat. No. 4,893,726 and D'Hoogue et al., U.S. Pat. No. 4,875,600.

SUMMARY OF THE INVENTION

The present invention is directed to the discovery of a new dispenser for laundry products, particularly for fabric softener products to be used in the dryer. In a first embodiment, the dispenser comprises a hollow ball having a plurality of product dispensing openings and a further product ingress opening for placing product in the ball. A measuring cup to hold product is accessed from the product ingress opening.

In accordance with one preferred embodiment, the measuring cup includes only a single opening in its side wall for releasing product from the cup and into the hollow sphere. One or more closures are associated with the dispenser and prevent the liquid from exiting through the product ingress opening from the interior of the cup to the exterior of the ball. This confines the product, once it has been filled into the cup, and limits its route of egress to the single hole in the side wall of the cup. After travelling through the small hole in the cup, the product can then be dispensed to the exterior of the hollow ball through the product dispensing openings and thus onto product. Use of a single hole in the cup can be expected to be advantageous in that a partial vacuum can be created in the cup whereby exit of product through the hole will be impeded so that product is not dispensed too quickly.

The hollow ball is preferably a manually squeezable plastic such as polyurethane. The product dispensing openings in the hollow ball are preferably small, preferably no more than 0.25 inches in diameter and most preferably within the range of 0.05 inches to 0.25 inches up to 0.05 inches in diameter. The cup is preferably friction fitted within the squeezeable plastic of the ball.

In accordance with a preferred embodiment, both the hollow ball and the cup are sufficiently translucent, especially transparent, to permit viewing of product levels within the cup by the consumer from the exterior of the dispenser when the dispenser is closed.

The dispenser preferably is comprised of materials having melting points no less than 180° F., preferably no less than 200° F., to permit it to survive intact the elevated temperatures of the dryer and is usable for multiple uses, e.g., 100 times or more.

In another embodiment, the cup includes more than the single hole in the cup walls. In this embodiment the cup contains a fabric softening product which is liquid at 78° F.

In a further embodiment, the cup may include a single hole or a plurality of holes and the hollow ball has associated therewith fabric on the outside surface to assist in evenly dispensing product.

In an alternative embodiment, the cup includes a single hole or a plurality of holes and the outside of the hollow ball includes a plurality of wells to assist in dispensing of product. In this embodiment the product can be "printed" onto the clothing.

The closure may be, for example, screwed onto the hollow ball and/or associated with the hollow ball by means of a hinge or other structures. However, in accordance with a still further embodiment of the invention, the dispenser includes a duck bill valve sealingly mounted within the measuring cup. Product can be pumped into the dispenser through the duck bill valve, in which case, the closure may be omitted if desired. The duck bill valve will be sealingly mounted within the measuring cup so that the product within the cup will be confined thereto (except for any openings in the walls of the cup leading to the interior of the hollow ball).

The one or more openings in the cup of the present invention will generally be of a relatively small size, particularly from 0.025 inches to 0.250 inches.

Where the duck bill valve is used, it will generally form a part of a plug which can be sealed to the dispenser, eg. by sonic welding. The plug can be sealed either to the hollow ball or to the cup.

If so desired, the cup may include indicia for guiding the consumer to add sufficient product for the desired treatment.

In accordance with yet another embodiment of the invention, the area of the closure on the hollow ball is recessed and is protected by a ridge of plastic formed in the hollow ball. Since the closure will often be fabricated from a harder material than the hollow ball, the ridge will minimize contact of the closure with objects, such as the interior of the dryer. This will minimize damage to the closure and to the dryer interior and also decrease the noise which might otherwise be generated by collisions between the hard-surfaced closure and the hard-surfaced dryer or other washing apparatus.

For a more complete understanding of the above and other features and advantages of the invention, reference should be made to the following Detailed Description of the Preferred Embodiments and to the accompanying drawings.

DETAILED DESCRIPTION OF THE INVENTION

Figure 1:
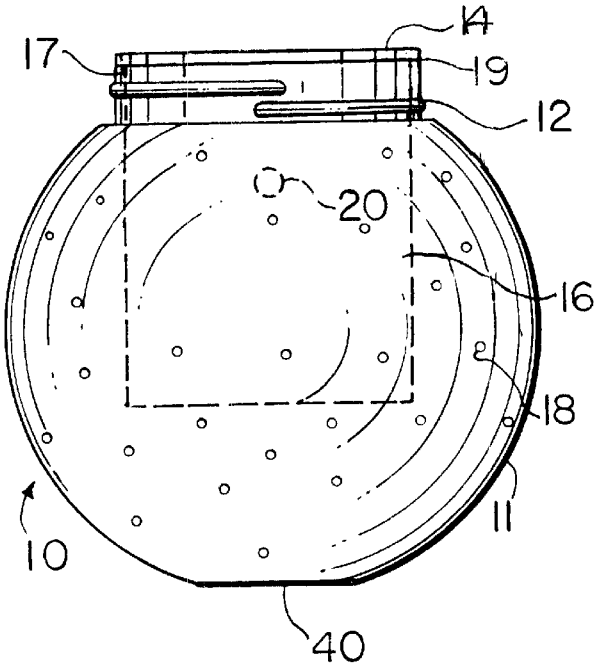
FIG. 1 is a front elevational view of a dispenser according to the invention without its closure.
Figure 2:
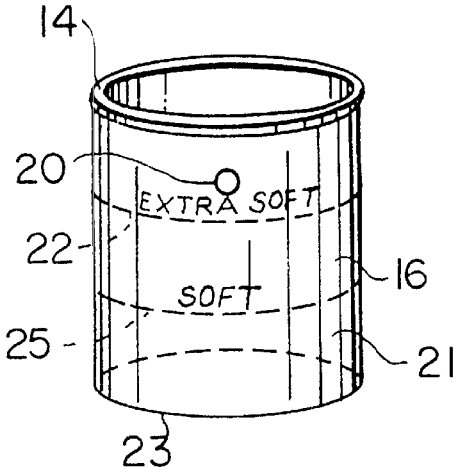
FIG. 2 is a perspective view of a cup for use within the dispenser of the invention.

As seen in FIG. 1, dispenser 10 comprises hollow ball 11 having small holes 18 formed therein. Through holes 18 the interior of ball 11 is in liquid communication with the exterior of the ball. Ball 11 includes finish 17 and screw threads 12. Atop finish 17 is product ingress aperture 19 in which is mounted measuring cup 16. Flange 14 of measuring cup 16 rests atop finish 17.

Figure 3:
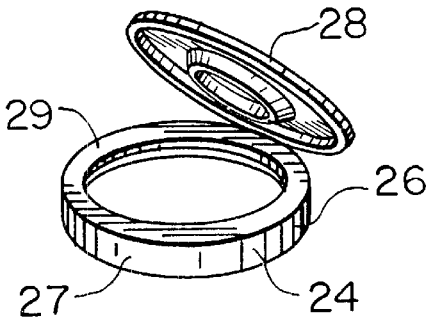
FIG. 3 is a perspective view of a closure for use in the dispenser of the invention.

Measuring cup 16 includes a single opening in side wall 21 and no opening in bottom wall 23. The size of opening 20 is small relative to the size of the product ingress opening 19. Measuring cup 16 includes fill lines 22 and 25 indicating the levels for soft and extra soft clothing when fabric softener is to be added to the measuring cup. Closure 24 (see FIG. 3) includes hinge to which is attached over cap 28. Closure 24 also comprises base closure 26 having depending wall 27 and perpendicular flange 29. The inside of depending wall 27 includes screw threads which mate with the screw threads 12 of cup 16 when the closure is screwed onto the ball. Upon screwing of the closure onto the cup, flange 29 is imposed upon flange 14 of measuring cup 16 thereby sealing the flange to the finish of hollow ball 11. Consequently, when the closure is screwed onto the ball, little or no liquid from the interior of the cup can enter the hollow areas of hollow ball 11 exterior to the cup except through opening 20.

Bottom 40 of ball 18 is generally flat so that it can be stably placed on a surface. In operation, a liquid fabric softener or other consumer product can be placed in cup 16 after which the closure 24 is screwed onto the finish 17. Overcap 28 may be snapped into the closed position as desired. The dispenser as thus prepared is placed into the dryer with drying clothes. The motion of the dryer agitates the hollow ball, and product exits from cup 16 through aperture 20 into the interior of hollow ball 11 exterior to cup 16. Egress of product from cup 16 through the product ingress opening 19 is blocked by the closed closure. Because there is a single opening 20, product exiting cup 16 creates a vacuum which helps to limit the rate of product exiting from the cup. It is generally undesirable for large amounts of the fabric softener to be applied to clothes simultaneously. As the ball tumbles, liquid covers the exit hole in the cups sidewall.

Figure 4:
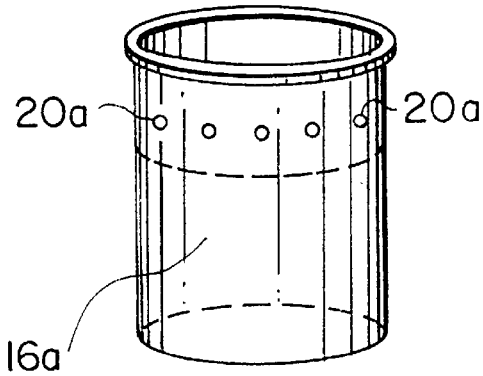
FIG. 4 is a perspective view of an alternative cup for use in the present invention.

In the FIG. 4 embodiment, a plurality of holes are used.

Figure 5:
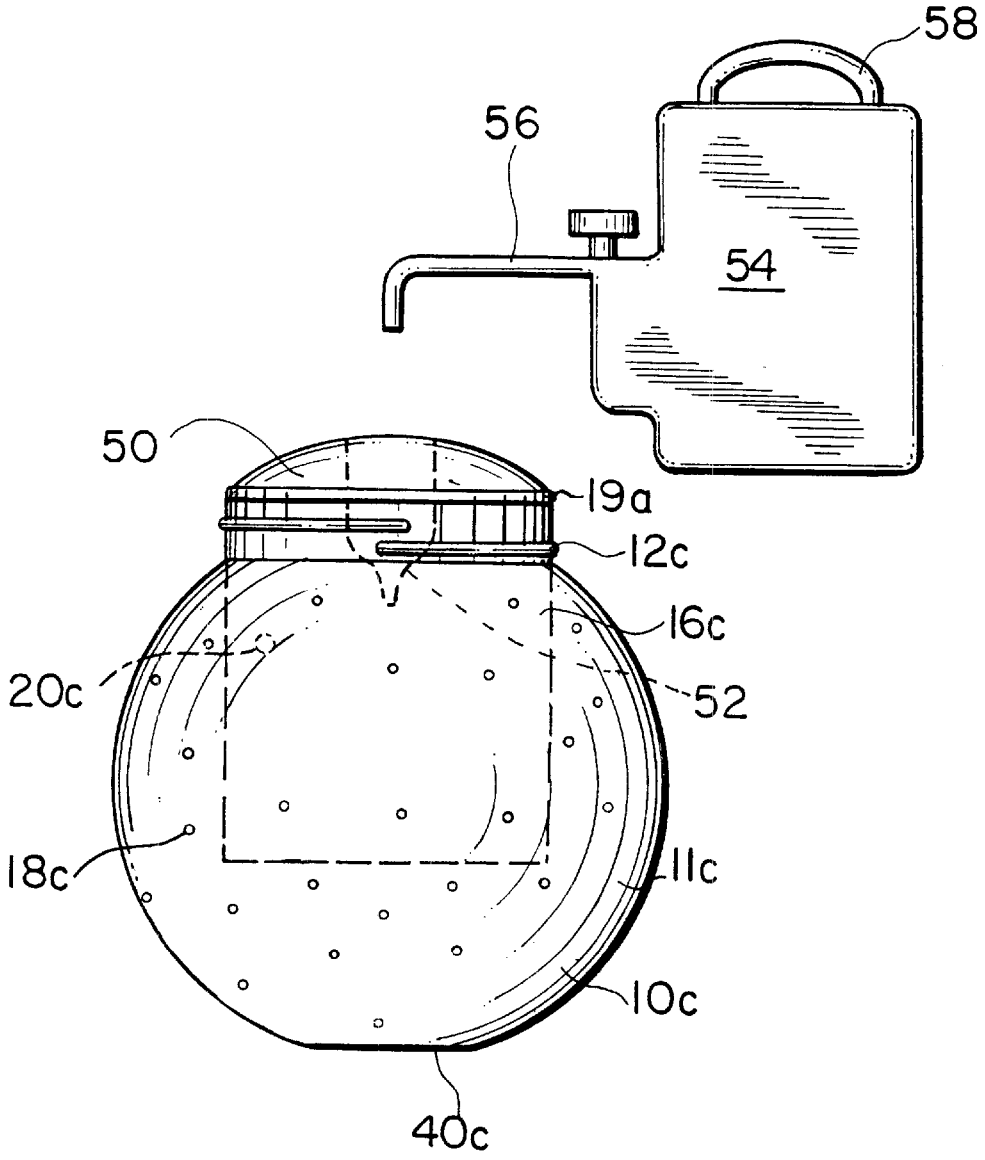
FIG. 5 is a front elevational view of a dispenser according to the invention shown with a bottle and pump thereabove (not to scale).

In FIG. 5, duck bill valve 52 is contained within plug seal 50 which seals the product ingress opening 19*a*. In operation, product may for instance be pumped from bottle 54 having handle 58 and spigot 56 into duck bill valve 52. The duck bill valve is a one way valve (one way into the cup) and so product can not exit through the valve and can exit only through aperture 20*c*.

In any of the above embodiments, once product has exited the cup, it will be contained within the hollow interior of ball 11 or 11*c* until it exits through openings 18*c* or 18 in the hollow body and is thereafter dispensed onto the clothes.

Figure 6:
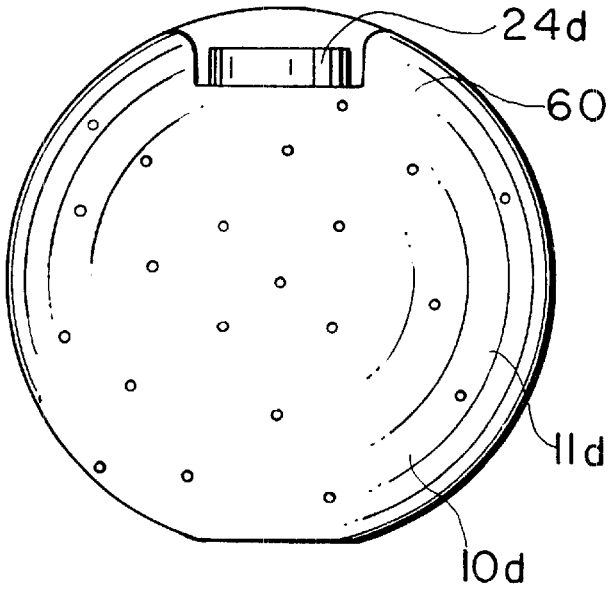
FIG. 6 is shows a front elevational view of an alternative dispenser according to the invention.
Figure 7:
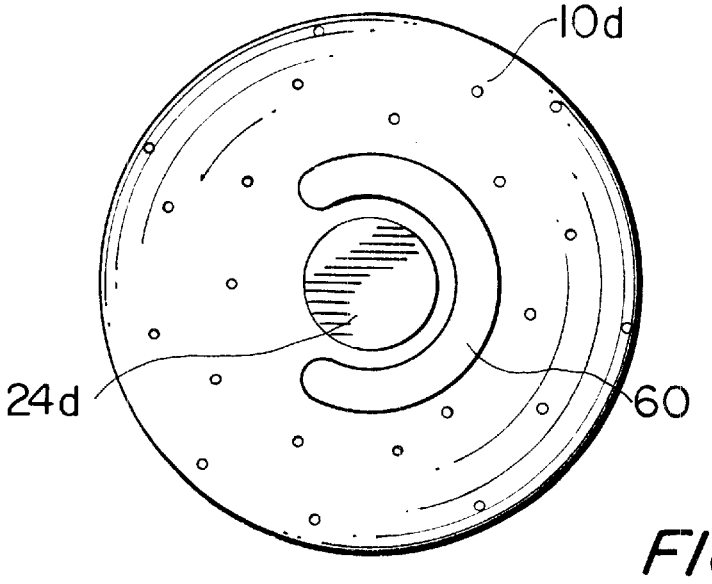
FIG. 7 is a top plan view of the dispenser of FIG. 6.

It will be appreciated that closure 24 may be made of a hard material such as polypropylene. In such case, it could be damaged or cause damage in colliding with the interior of a dryer or other laundry apparatus. Moreover, collision of a hard closure with the interior of a dryer or other apparatus may cause considerable noise. The embodiment of FIGS. 6 and 7 is designed to shield closure 24 and protect the ears of the user and those of passerbys from undue noise. In the FIG. 6 embodiment, closure 24*d,* and therefore the product ingress opening, and also the measuring cup, are of a much smaller diameter. Closure 24*d* is protected by ridge 60 which extends about the closure, preferably at least 260° C. Ridge 60 is made of the same soft plastic material as ball 11*d*. The top of ridge 60 is preferably at least 0.125 inches, especially at least 0.25 inches, higher than the highest point on closure 24*d*.

The hollow ball of the invention may be made either by injection molding or blow molding, but where a ridge is present injection molding is preferred.

The closure may be made of various plastic materials such as polypropylene, polypropylene copolymer or high density polyethylene.

Figure 8:
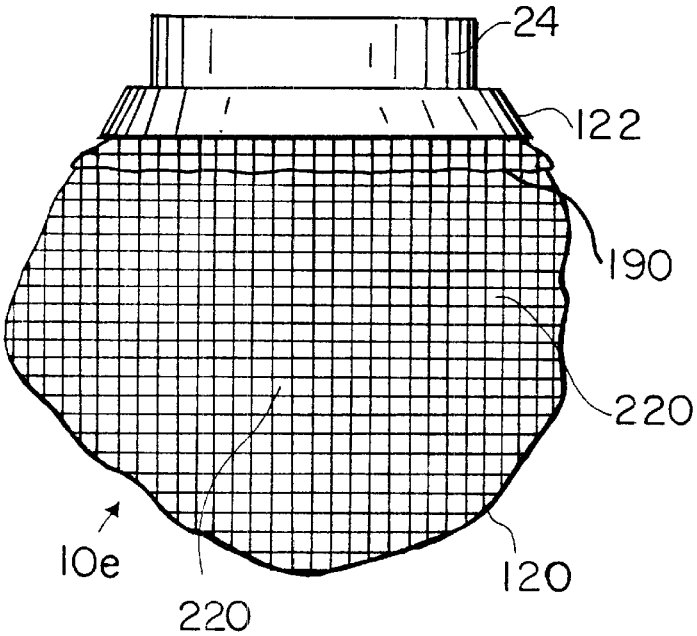
FIG. 8 is a front elevational view of an alternative dispenser of the invention.
Figure 12:
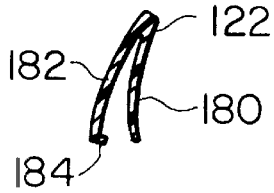
FIG. 12 is a cross section along the lines 12–12 of the collar of FIG. 11.
Figure 11:
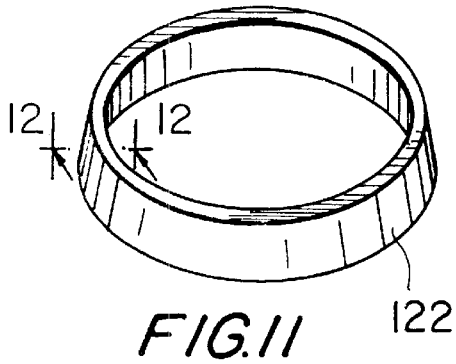
FIG. 11 is a perspective view of a collar according to the invention.
Figure 9:
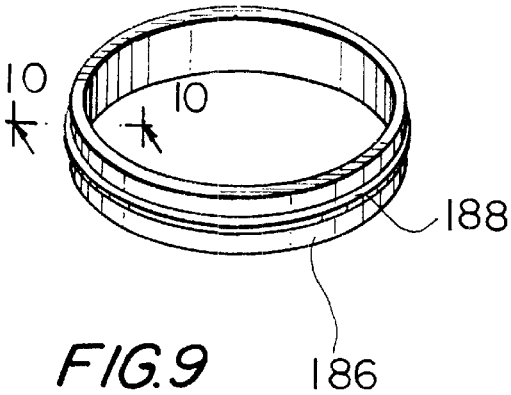
FIG. 9 is a perspective view of a ring according to the invention.
Figure 10:
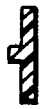
FIG. 10 is a cross section along the lines 10–10 of FIG. 9.

FIG. 8 illustrates an alternative embodiment wherein fabric is used on the exterior of the dryer ball to assist in the distribution of the product. The fabric 120, which may be a non-woven fabric, such as a polyolefin like low or high density polyethylene or polypropylene, is retained on the ball (not shown) of dispenser 10*e* by retaining collar 122. As best seen in FIG. 12, collar 122 comprises two depending walls 180 and 182 joined at the top. At the bottom of wall 182 is an inwardly extending ring 184. Collar 122 is adapted to receive between the two walls locking ring 186 and the non-woven fabric. Ring 186 includes outwardly extending locking ring 188.

The FIG. 8 embodiment is assembled by wrapping non-woven fabric 120 about the hollow ball from the bottom upwardly. As a result, only the area of closure 24 and adjacent areas of the ball are not covered by the fabric. Ring 186 is then placed above the ball and moved downwardly until upper edges 190 of the fabric are disposed on one side of the ring and the main body of the fabric on the other. Then, the upper edges of the fabric are bent outwardly and downwardly and collar 122 is snapped onto ring 186 thereby retaining ring 186 as well as the upper edges of the fabric or area adjacent thereto. Retaining ring 184 combines with locking ring 186 to help lock the fabric in place. The diameters of collars 122 and ring 186 are preferably less than the diameter of the ball.

Figure 13:
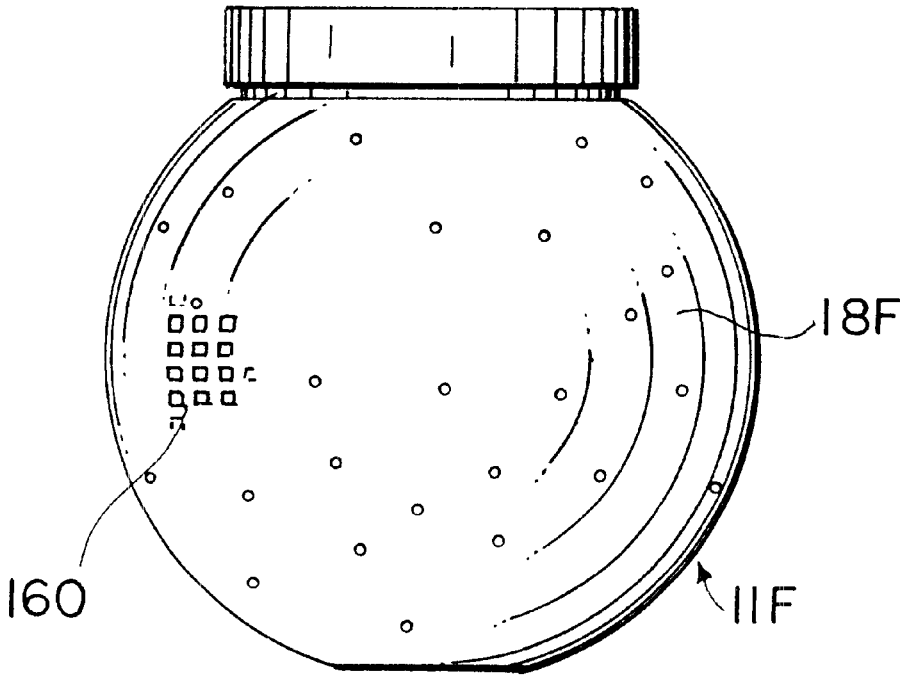
FIG. 13 is a front elevational view of an alternative embodiment of the dispenser.

In FIG. 13, the exterior of ball 11*f* includes shallow wells or dimples 160 in addition to holes 18*f*. In this embodiment product which passes along the surface of the ball from the interior through holes 18*f* is temporarily captured by the wells. This permits the ball to "print" product onto clothing or other fabrics during drying when the ball makes contact with the clothing or other fabrics.

It should be understood of course that specific forms of the invention herein illustrated and described are intended to representative only as certain changes may be made therein without departing from the clear teachings of the disclosure. Accordingly reference should be made to the following appended claims in determining the full scope of the invention.

What is claimed is:

1. A dispenser comprising:

(a) a hollow ball having a plurality of ball dispensing openings from the hollow interior to the exterior of said ball, (b) a product ingress opening in said ball, (c) a measuring cup including an open end and at least one side wall and an optional bottom wall, mounted within said ball, (d) said measuring cup open end being in liquid communication with said product ingress opening of said ball, (e) said measuring cup having a single opening in one of said side and bottom walls, (f) one or more closures associated with said dispenser to suspend liquid communication through said product ingress opening between the interior of said cup and the exterior of said ball.

2. The dispenser according to claim 1 wherein said hollow ball is comprised of a manually squeezable plastic.

3. The dispenser according to claim 2 wherein said hollow ball is comprised of polyurethane.

4. The dispenser according to claim 3 wherein said cup is comprised of natural or clarified polypropylene.

5. The dispenser according to claim 1 wherein said ball dispensing openings are no more than 0.25 inches in diameter.

6. The dispenser according to claim 5 wherein said ball dispensing openings range in size from pin-hole size up to 0.25 inches in diameter.

7. The dispenser according to claim 1 wherein said hollow ball and said cup are sufficiently translucent to permit viewing of product levels within said cup.

8. The dispenser according to claim 1 wherein said hollow ball and said cup are transparent.

9. The dispenser according to claim 1 comprised of materials having melting points no less than 200° F.

10. The dispenser according to claim 1 further comprising fabric associated with the exterior of said hollow ball for facilitating dispensing of product.

11. The dispenser according to claim 1 further comprising wells on a surface of said hollow ball.

12. The dispenser according to claim 1 wherein said measuring cup open end is not in liquid communication with the hollow interior of said ball exterior to said cup.

13. The dispenser according to claim 1 wherein said closure includes screws which mate with screws on said hollow ball to close the product ingress opening of said dispenser.

14. The dispenser according to claim 13 further comprising anti-rotational ratchets.

15. The dispenser according to claim 1 wherein said closure is hingedly attached to said hollow ball.

16. The dispenser according to claim 1 further wherein said hollow ball includes a protective ridge extending above said closure.

17. The dispenser according to claim 16 wherein said ridge extends for at least one inch above the uppermost surface of said closure and extends at least 200° around said closure.

18. A combination of a dispenser including:

(a) a hollow ball having a plurality of ball dispensing openings from the hollow interior to the exterior of said ball, (b) a product ingress opening in said ball, (c) a measuring cup including an open end and at least one side wall and an optional bottom wall, mounted within said ball, (d) said measuring cup open end being in liquid communication with said product ingress opening of said ball, (e) said measuring cup having a single opening in one of said side and bottom walls, (f) one or more closures associated with said dispenser to suspend liquid communication through said product ingress opening between the interior of said cup and the exterior of said ball; and a laundry product contained with said measuring cup.

19. The combination of claim 18 wherein said laundry product is a fabric softener.

20. The combination of claim 18 wherein said fabric softener is a liquid at 78° F.

21. A combined dispenser and fabric treatment product comprising:

(a) a hollow ball having a plurality of openings from the hollow interior to the exterior of said ball, (b) a product ingress opening in said ball, (c) a measuring cup including an open end and at least one side wall and an optional bottom wall, mounted within said ball, (d) said measuring cup open end being in liquid communication with said product ingress opening of said ball, (e) said measuring cup having at least one opening in one of said side and bottom walls, (f) one or more closures associated with said dispenser to suspend liquid communication through said product ingress opening between the interiors of said ball and said cup and the exterior of said ball, (g) said cup containing a fabric softening product which is liquid at 78° F.

22. The dispenser according to claim 21 wherein said measuring cup open end is not in liquid communication with the hollow interior of said ball exterior to said cup.

23. The dispenser according to claim 21 wherein said hollow ball is comprised of a manually squeezable plastic.

24. The dispenser according to claim 21 wherein said hollow ball is comprised of polyurethane.

25. The dispenser according to claim 21 wherein said ball dispensing openings are no more than 0.25 inches in diameter.

26. The dispenser according to claim 21 wherein said hollow ball and said cup are sufficiently translucent to permit viewing of product levels within said cup.

27. The dispenser according to claim 21 comprised of materials having melting points no less than 180° F.

28. A dispenser comprising:

(a) a hollow ball having a plurality of openings from the hollow interior to the exterior of said ball, (b) a product ingress opening in said ball, (c) a measuring cup including an open end and at least one side wall and an optional bottom wall, mounted within said ball, (d) said measuring cup open end being in liquid communication with said product ingress opening of said ball, (e) said measuring cup having at least one opening in one of said side and bottom walls, (f) one or more closures associated with said dispenser to suspend liquid communication through said product ingress opening between the interiors of said ball and said cup and the exterior of said ball, (g) said hollow ball comprising at least one of i) a fabric associated with the outside surface of said ball and ii) a plurality of wells on said outside ball surface.

29. The dispenser according to claim 28 in combination with a fabric softening product which is liquid at 78° F. contained within said cup.

30. A dispenser comprising:

(a) a hollow ball having a plurality of openings from the hollow interior to the exterior of said ball, (b) a product ingress opening in said ball, (c) a measuring cup including a first end and at least one side wall and an optional bottom wall, mounted within said ball, (d) said measuring cup first end including a duck bill valve sealingly mounted therewithin, said valve being in liquid communication with said product ingress opening of said ball, (e) said measuring cup having at least one opening in one of said side and bottom walls.

31. The dispenser according to claim 30 in combination with a fabric softening product which is liquid at 78° F. contained within said cup.

32. The dispenser according to claim 30 wherein said hollow ball is comprised of a manually squeezable plastic.

33. The dispenser according to claim 30 wherein said ball dispensing openings are no more than 0.25 inches in diameter.

34. The dispenser according to claim 30 wherein said hollow ball and said cup are sufficiently translucent to permit viewing of product levels within said cup.

35. A dispenser comprising:

(a) a hollow ball having a plurality of openings from the hollow interior to the exterior of said ball, (b) a product ingress opening in said ball, (c) a measuring cup including an open end and at least one side wall and an optional bottom wall, mounted within said ball, (d) said measuring cup open end being in liquid communication with said product ingress opening of said ball, (e) said measuring cup having at least one opening in one of said side and bottom walls, (f) one or more closures associated with said dispenser to suspend liquid communication through said product ingress opening between the interiors of said ball and said cup and the exterior of said ball, said hollow ball including a protective ridge extending above said closure.

36. The dispenser according to claim 35 wherein said ridge extends for at least one inch above the uppermost surface of said closure and extends at least 200° around said closure.

* * * * *

UNITED STATES PATENT AND TRADEMARK OFFICE

CERTIFICATE OF CORRECTION

PATENT NO. : 6,574,883 B2
DATED : June 10, 2003
INVENTOR(S) : Giblin et al.

It is certified that error appears in the above-identified patent and that said Letters Patent is hereby corrected as shown below:

Title page,
Item [54], the title reads "DISPENSING FOR DRYER" change to read
-- DISPENSING BALL FOR DRYER --

Signed and Sealed this

Sixteenth Day of September, 2003

JAMES E. ROGAN
*Director of the United States Patent and Trademark Office*